US005927174A

United States Patent [19]

Newnes et al.

[11] Patent Number: 5,927,174

[45] Date of Patent: Jul. 27, 1999

[54] INCLINE WEDGE VARIABLE TARGET SIZE SAWGUIDES FOR CIRCULAR GANG SAWS

[75] Inventors: William R. Newnes; Steven Michell; John Sergeant, all of Salmon Arm, Canada

[73] Assignee: CAE Electronics Ltd., St. Laurent, Canada

[21] Appl. No.: 08/840,882

[22] Filed: Apr. 17, 1997

[51] Int. Cl.[6] ..... B26D 5/00

[52] U.S. Cl. ..... 83/827; 83/821; 83/828; 83/829; 83/13

[58] Field of Search ..... 83/821, 827, 828, 83/829, 425.2, 425.3, 425.4, 447, 508.3, 13

[56] References Cited

U.S. PATENT DOCUMENTS

| | | | |
|---|---|---|---|
| 193,004 | 7/1877 | Jenks | 83/425.3 |
| 261,645 | 7/1882 | Winter | 83/425.3 |
| 344,175 | 6/1886 | East | 83/827 |
| 477,861 | 6/1892 | Hinkley | 83/828 |
| 1,802,514 | 4/1931 | Johnson | 83/425.4 |
| 2,619,995 | 12/1952 | Gordon | 83/425.4 |
| 2,992,661 | 7/1961 | Burelbach | 83/508.3 |
| 3,285,302 | 11/1966 | Thrasher | 83/829 |
| 3,674,065 | 7/1972 | Fairfield, Jr. et al. | 83/821 |
| 3,688,820 | 9/1972 | Lundblom | 143/160 |
| 3,742,796 | 7/1973 | McMillan | 83/102.1 |
| 3,750,513 | 8/1973 | Cromeens | 83/425.4 |
| 3,828,635 | 8/1974 | Smith | 83/425.3 |
| 3,918,334 | 11/1975 | Wilcox | 83/821 |
| 3,992,614 | 11/1976 | Buss | 235/151.1 |
| 4,031,790 | 6/1977 | Arvidsson | 83/425.2 |
| 4,414,875 | 11/1983 | Pearson | 83/508.3 |
| 4,690,188 | 9/1987 | Hasenwinkle | 144/378 |
| 4,848,200 | 7/1989 | McGehee | 83/169 |
| 4,909,112 | 3/1990 | Rosenthal | 83/425.4 |
| 4,977,802 | 12/1990 | Kirbach | 83/13 |
| 5,287,782 | 2/1994 | Scott | 83/447 |
| 5,325,751 | 7/1994 | Green et al. | 83/13 |

FOREIGN PATENT DOCUMENTS

| | | | |
|---|---|---|---|
| 592592 | 2/1978 | U.S.S.R. | 83/508.3 |
| 1579779 | 7/1990 | U.S.S.R. | 83/821 |

*Primary Examiner*—M. Rachuba
*Assistant Examiner*—Stephen Choi
*Attorney, Agent, or Firm*—Anthony C. Edwards

[57] ABSTRACT

A sawguide positioning method for circular gang saws mounted on a single saw arbor shaft. A guide bar is positioned generally parallel to the saw arbor shaft. A plurality of sawguide pairs are slidably mounted on the guide bar for longitudinal axial travel thereon. The guides extend on either side of each of the circular saws. A pair of opposed sawguide positioning wedges are threadably mounted on a selectively rotatable shaft having a right hand threaded end and a left hand threaded end, the axis of the shaft being generally at right angles to both the saw arbor shaft and the guide bar. The wedges are threaded on to the selectively rotatable shaft with their vertices innermost. The threaded shaft has an enlarged diameter portion or disk intermediate the threaded ends which is rotatably positioned within matching recesses in the opposed faces of the sawguides. Selective rotation in either direction of the shaft causes axial travel of the positioning wedges along the shaft toward or away from the disk thereby repositioning the sawguides and changing the spacing between the saw blades. Confinement of the disk on the shaft within the mating recesses prohibits any longitudinal translation of the shaft relative to the sawguides thereby maintaining the opposed sawguide positioning wedges equidistant from the center of the shaft and thereby permitting the positioning wedges to operate in unison. Once adjusted, the sawguides are squeezed together thereby maintaining accurate saw positioning.

5 Claims, 7 Drawing Sheets

INCLINE WEDGE VARIABLE TARGET SIZE SAWGUIDES FOR CIRCULAR GANG SAWS

FIELD OF THE INVENTION

This invention relates to a device for adjusting saw blade spacings in a circular gang saw, and, in particular, relates to interleaving between sawguides a pair of opposed facing adjustable wedges for remotely adjusting the saw spacings to thereby vary lumber target sizes.

BACKGROUND OF THE INVENTION

In the prior art, circular gang saws are typically mounted on a splined arbor. The saws in the gang saw are stabilized and positioned relative to each other on the splined arbor by sawguides. Each saw within the gang saw has a corresponding sawguide. Each sawguide has an opposed pair of rigid members spaced apart to allow the saw blade to pass between the opposed rigid members. The opposed rigid members support babbitt pads or the like which rub against the sides of the saw blade. The sawguides are sandwiched together in a laterally extending array across the laterally extending circular gang saw by means of a hydraulic press.

It is desirable to change the relative spacing between saws in the circular gang saw in order to cut different sized lumber from a cant being fed into the gang saw. In the prior art, changing the spacing between the saws in the gang saw meant stopping operation of the gang saw, releasing the hydraulic press, removing the sawguides and replacing the sawguides with sawguides of a different thickness and reassembling the gang saw with the saw blades set at the new spacing dictated by the new sawguides. This process typically caused considerable down time and lost productivity. It did not allow for the quick changing of the lumber target size for which the gang saw was preset.

Consequently, it is an object of the present invention to provide a circular gang saw having adjustable sawguides, adjustable by means of a remote control system and selectively actuable actuators so as to thereby reduce the time required to change lumber target size, the device not requiring the breakdown and reassembly of the sawguides in order to change lumber target size.

SUMMARY OF THE INVENTION

An apparatus for the adjustment of sawblade spacing in a gang saw adjusts saw blades to different target lumber sizes, without having to dismantle the gang saw to remove and replace each sawguide. The gang saws are equipped with splined saw blade arbors. The sawguides may be of the babbitt pad type which hold the blades in position by contacting the blade sides with sawguide pads. Each sawguide pair incorporates a pair of cooperating, opposed wedges that are threaded onto a threaded rod. The threaded rod has left and right hand threads extending respectively, from the center of the rod to the opposite ends of the rod. Mounted rigidly onto the threaded rod, in the center of the threaded rod (relative to its length) and centered between the pair of opposed wedges when the wedges are threaded onto the threaded rod, is a disc or other centering or mounting means that holds the threaded rod longitudinally stationary relative to, and between the sawguides, in opposed recesses in opposed sawguide surfaces. The centering means is free to rotate in the opposed recesses thereby allowing the rod to rotate while remaining centered relative to the sawguides. In its simplest form, the disc may be a washer welded to the rod. The flanges on the washer have to be large enough so that when the sawguides are separated a maximum distance apart, the flanges will not pull free of the recesses.

The sawguide pairs are attached to a sawguide bar that runs through the gang. The opposed facing sawguide surfaces of the sawguide pairs each have an inclined surface that matches or generally corresponds to the corresponding surfaces of the wedges. The centering means is positioned in the center of the sawguide pairs' width and holds the wedges at equal distance apart along the length of the threaded rod as the wedges move in towards the center along the rod, to thereby ride up the incline when the threaded rod is rotated one direction (thus expanding the sawguide pairs), or when the wedges move out toward the outer edges of the sawguides (i.e. away from the center of the rod), to thereby ride down the incline (thus contracting the sawguide pairs) when the threaded rod is rotated in the opposite direction. Each threaded rod is rotated by a linkage that is in turn rotated by a stepper motor (or other means).

The sawguides are pressed together by a press that fixes the lumber target size after the adjustment has been made. The sawguide bar has two opposing flat sides that allow the sawguides to be removed, by first releasing the press, spreading the sawguides apart, withdrawing the rod linkage and removing the wedge sets and attached threaded rod. The threaded rods all can be simultaneously rotated the same amount, or individually to selectively create different zones, or areas of sawguide pairs, across the gang saw, having selectively different thickness target sizes in those zones.

In summary, the device for selectively actuable positioning of sawguides for circular gang saws mounted on a saw arbor shaft comprises a first shaft such as a guide bar extending along a first axis generally parallel to the saw arbor shaft, first and second sawguides slidably mounted on the first shaft for longitudinal sliding thereon on opposed sides of first and second wedges mounted in threaded engagement, in left and right hand threaded engagement respectively, on a selectively rotatable second shaft extending between the first and second sawguides along a second axis generally perpendicular to the first axis, threadably journalled in the first and second wedges and rotatably centered and anchored between the first and second sawguides, the first and second wedges threadably mounted on the second shaft in opposed facing relation with the vertices of the first and second wedges closest to a center position centered along the second shaft, means for selectively rotating the second shaft so as to, when selectively rotated in a first direction, force the first and second wedges towards the center position, and when selectively rotated in a second direction counter to the first direction so as to force the first and second wedges away from the center position, means for urging the first and second sawguides slidably towards each other along the first shaft against the first and second wedges, respectively, whereby translation of the first and second wedges along the second shaft by reason of selective rotation of the second shaft causes relative longitudinal translation between the first and second sawguides on the first shaft.

The method of the present invention for selectively actuable positioning sawguides in circular gang saws mounted on a saw arbor shaft, wherein a first shaft extends along a first axis generally parallel to the saw arbor shaft, comprises the steps of: (a) slidably mounting a plurality of first and second sawguides on the first shaft, where each of the first and second sawguides are mounted on laterally opposite sides of corresponding opposed pairs of first and second wedges, (b) mounting the first and second wedges in threaded longitudinal engagement, in left and right threaded engagement respectively, on corresponding selectively rotatable second shafts mounted between the plurality of first and second sawguides along second axes generally perpendicular to the first axis, the second shafts threadably journalled in the corresponding opposed pairs of first and second wedges and rotatably centered and rotatably anchored between the first and second sawguides, the opposed pairs of first and second wedges threadably mounted on the corresponding second shafts in opposed facing relation with vertices of the first and second wedges closest to a center position centered along said corresponding second shafts, (c) selectively rotating the second shafts either individually or collectively, by rotating a selected or collective plurality of second shafts cooperatively journalled in a corresponding plurality of the first and second wedges, so as to, when selectively rotated in a first direction, force the first and second wedges towards the center position, and when selectively rotated in a second direction counter to the first direction so as to force the first and second wedges away from the center position, the selective rotating of a plurality of second shafts forming saw blade zones with selected spacing between saw blades, (d) urging the first and second sawguides slidably towards each other along the first shaft against the first and second wedges, respectively, whereby translation of the first and second wedges along the second shaft by reason of selective rotation of the second shaft causes relative longitudinal translation between the first and second sawguides on the first shaft.

The invention provides other advantages which will be made clear in the description of the preferred embodiments.

BRIEF DESCRIPTION OF THE DRAWINGS

The invention will be better understood by reference to the accompanying drawings, wherein.

DETAILED DESCRIPTION OF THE PREFERRED EMBODIMENT

Figure 1:
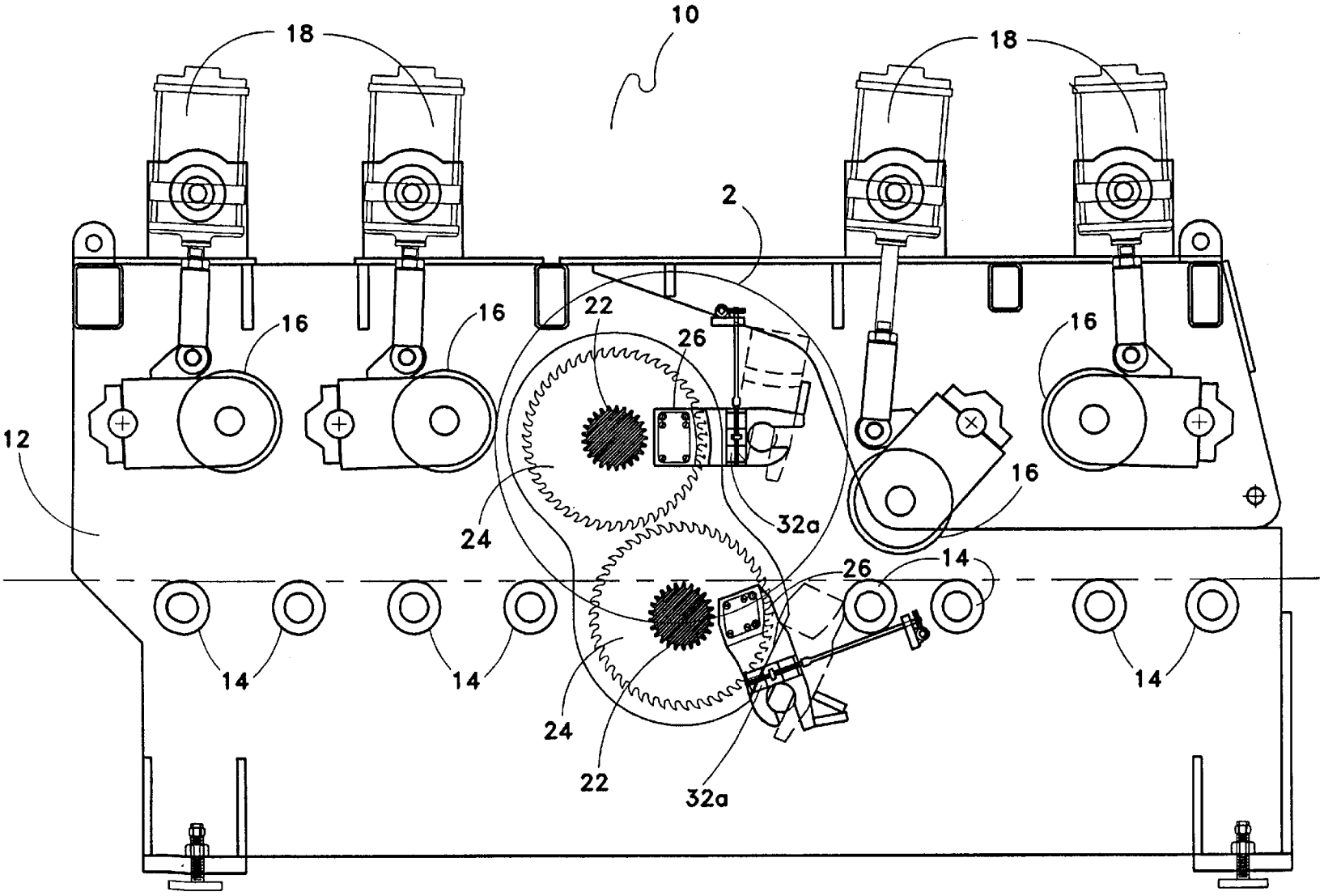
FIG. 1 is a side elevation view according to a preferred embodiment of the invention.
Figure 2:
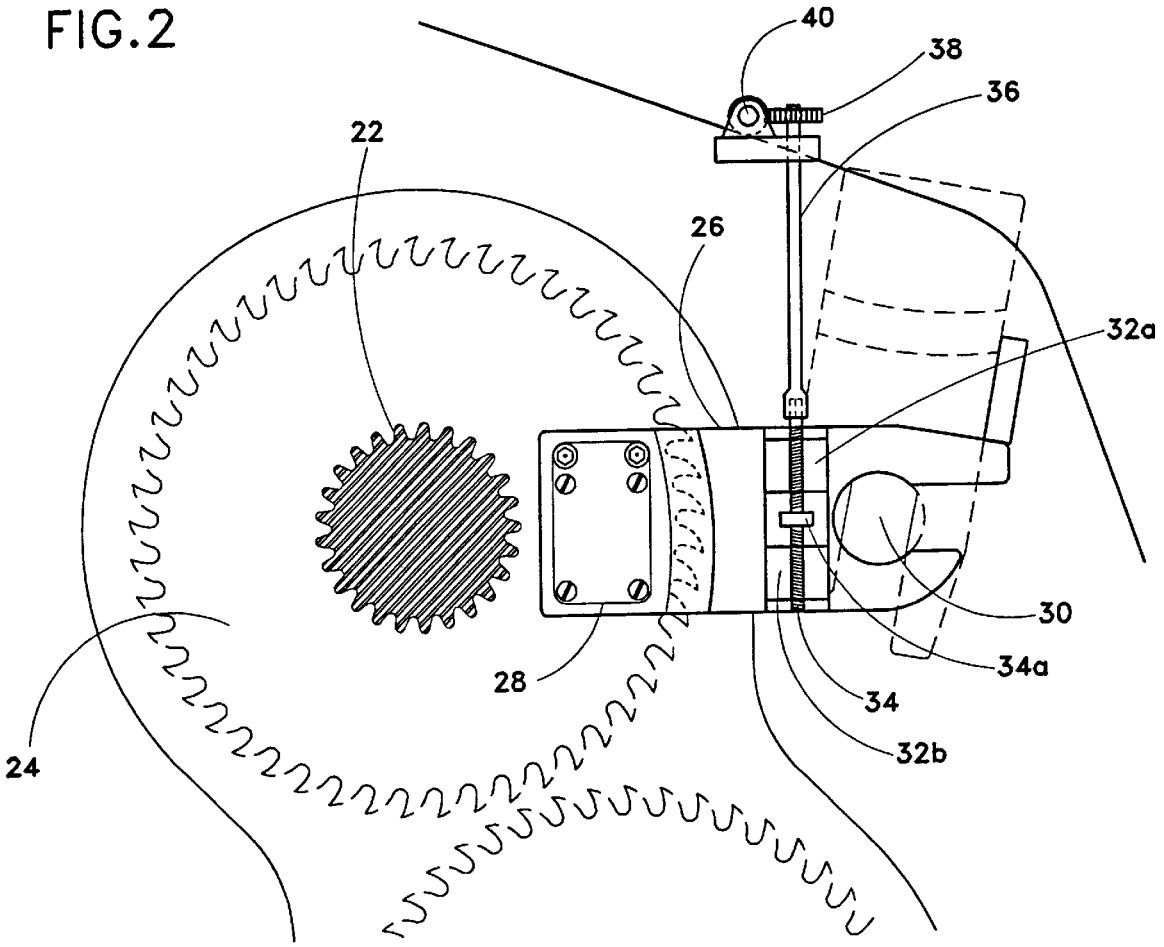
FIG. 2 is an enlarged, fragmentary, side elevation view taken from FIG. 1, showing sawguides in their down (operating) position and with dashed lines showing the guides in the saw removal position.
Figure 3:
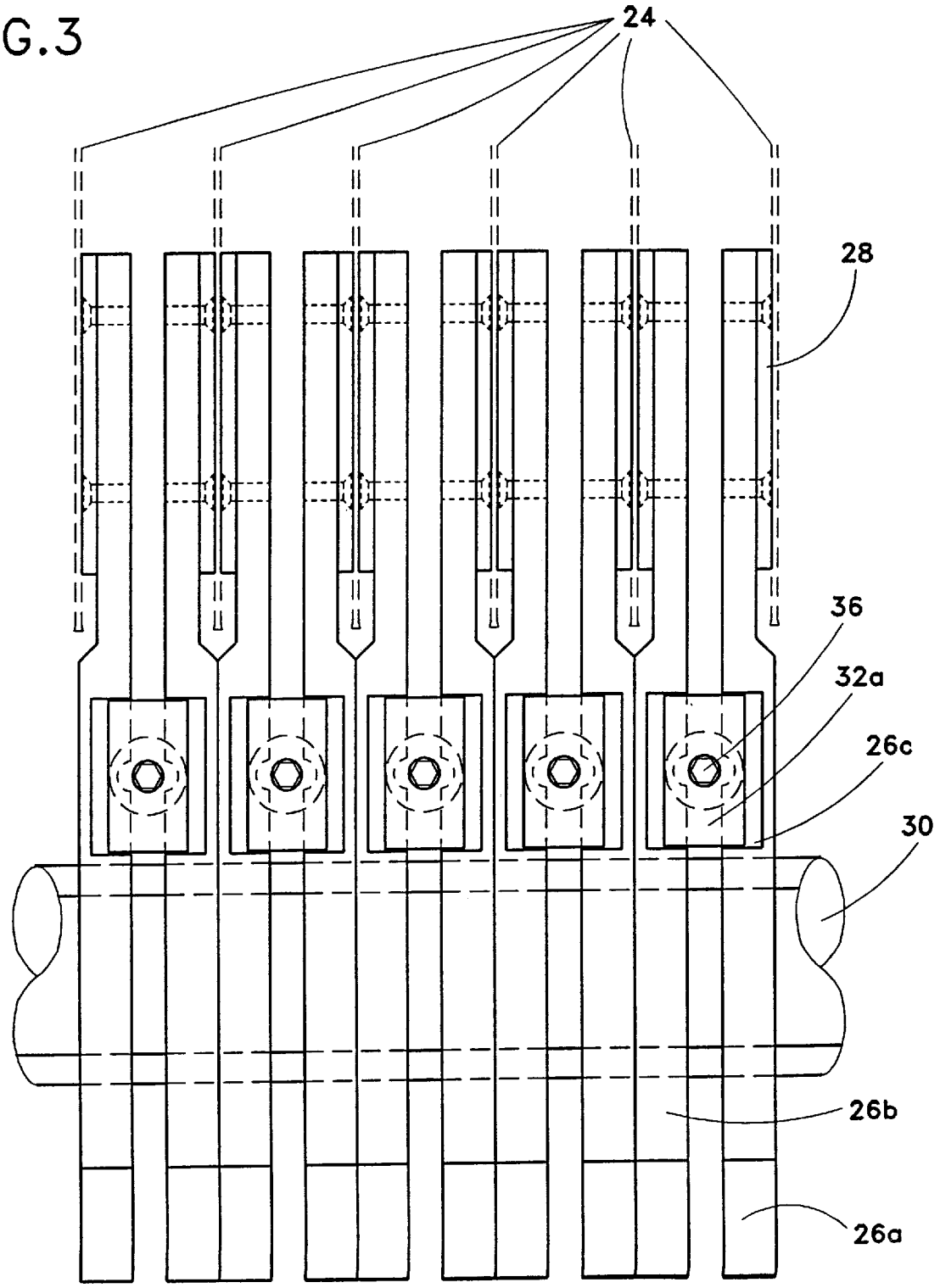
FIG. 3 is an enlarged, fragmentary, side cross-sectional view of the sawguides in their expanded position.
Figure 5A:
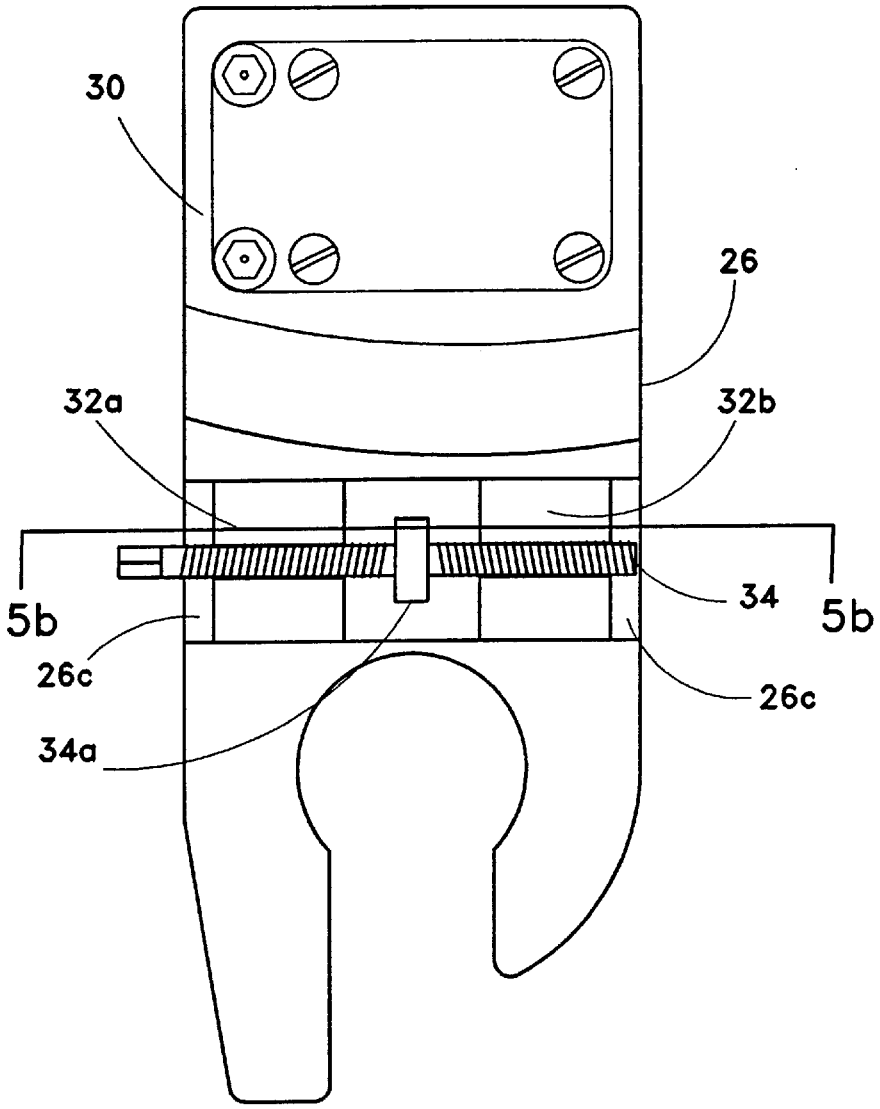
FIG. 5*a* is an enlarged side elevation view of a sawguide.
Figure 5B:
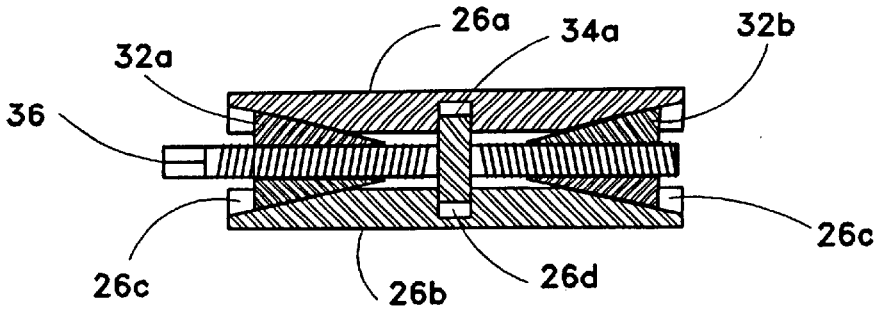
FIG. 5*b* is an end cross-sectional view taken along line A—A in FIG. 5*a;*

Referring to the drawing figures wherein similar characters of reference represent corresponding parts in each view, the apparatus is generally indicated by the reference numeral 10. As seen in FIG. 1, apparatus 10 includes a support frame constructed of various vertical and horizontal structural plates 12, a plurality of driven feed rollers 14, and press rolls 16 each having corresponding actuating cylinders 18. Splined saw arbor 22 has slidably mounted thereon a plurality of saw blades 24. As better seen in FIG. 2, each saw blade 24 is guided by a corresponding sawguide set 26. As seen in FIG. 3 each sawguide set 26 has two plates 26*a* and 26*b* mounted on the saw arbor 22 on either side of the corresponding saw blade 24. The sawguide sets 26 have mounted thereon sawguide pads 28. Sawguide pads 28 contact the saw blades 24, one on each side of the blade. Sawguide pairs 26 are mounted on a sawguide bar 30. As seen in FIGS. 5*a* and 5*b,* sawguide pairs 26 have mounted therebetween a pair of opposed wedges 32*a* and 32*b*. Sawguides 26 have recessed inclines 26*c* that accept wedges 32*a* and 32*b* in sliding engagement thereon.

Threaded rod 34 has left hand and right hand threads, extending in opposite directions along the rod from a disc or other centering means 34*a* rigidly affixed to the rod. Rod 34 is positioned between the wedges 32*a* and 32*b*. Sawguide pairs 26 have recess 26*d* for rotational mounting of disc 34*a* therein. Threaded rod 34 is attached to a linkage 36 by means of a male/female socket coupling or the like. Linkage 36 may be a flexible cable, a pair of universal joints combined with a slip-joint, or other suitable linkage means. The linkage 36 is connected to a linkage gear 38. Rotation of gear 38 is controlled by worm gear 40 or other means. Rotation of worm gear 40 is in turn controlled by a stepper motor or other means (not shown).

Figure 7:
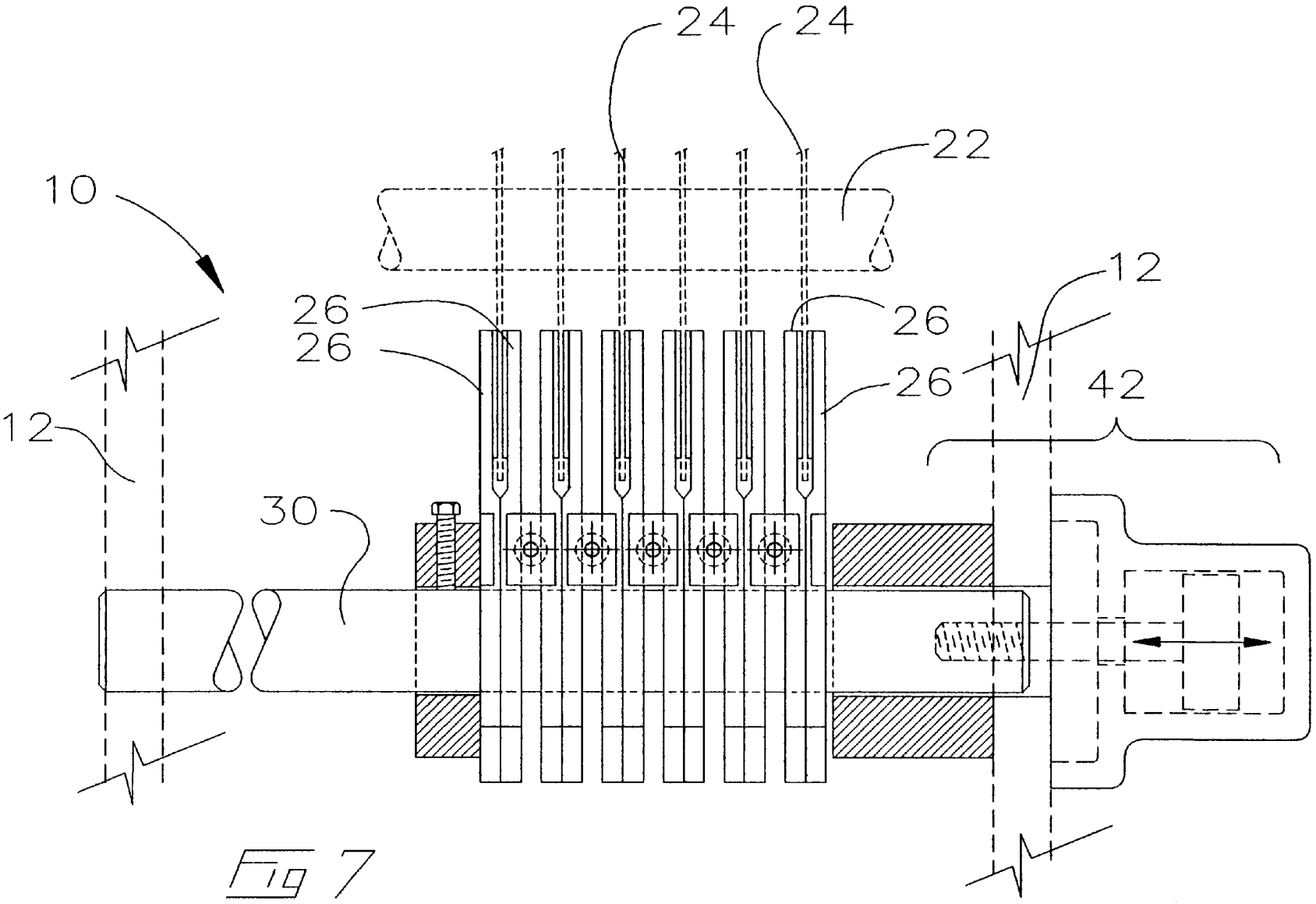
FIG. 7 is a view of FIG. 3 showing a hydraulic press.

Sawguide sets 26 and incline wedges 32*a* and 32*b* are pressed together so as to be sandwiched along the saw arbor by a hydraulic press 42, as seen in FIG. 7. The hydraulic press is backed off, when changing target lumber size settings, or when changing range sizes, sawguide pads or saw blades.

Figure 4:
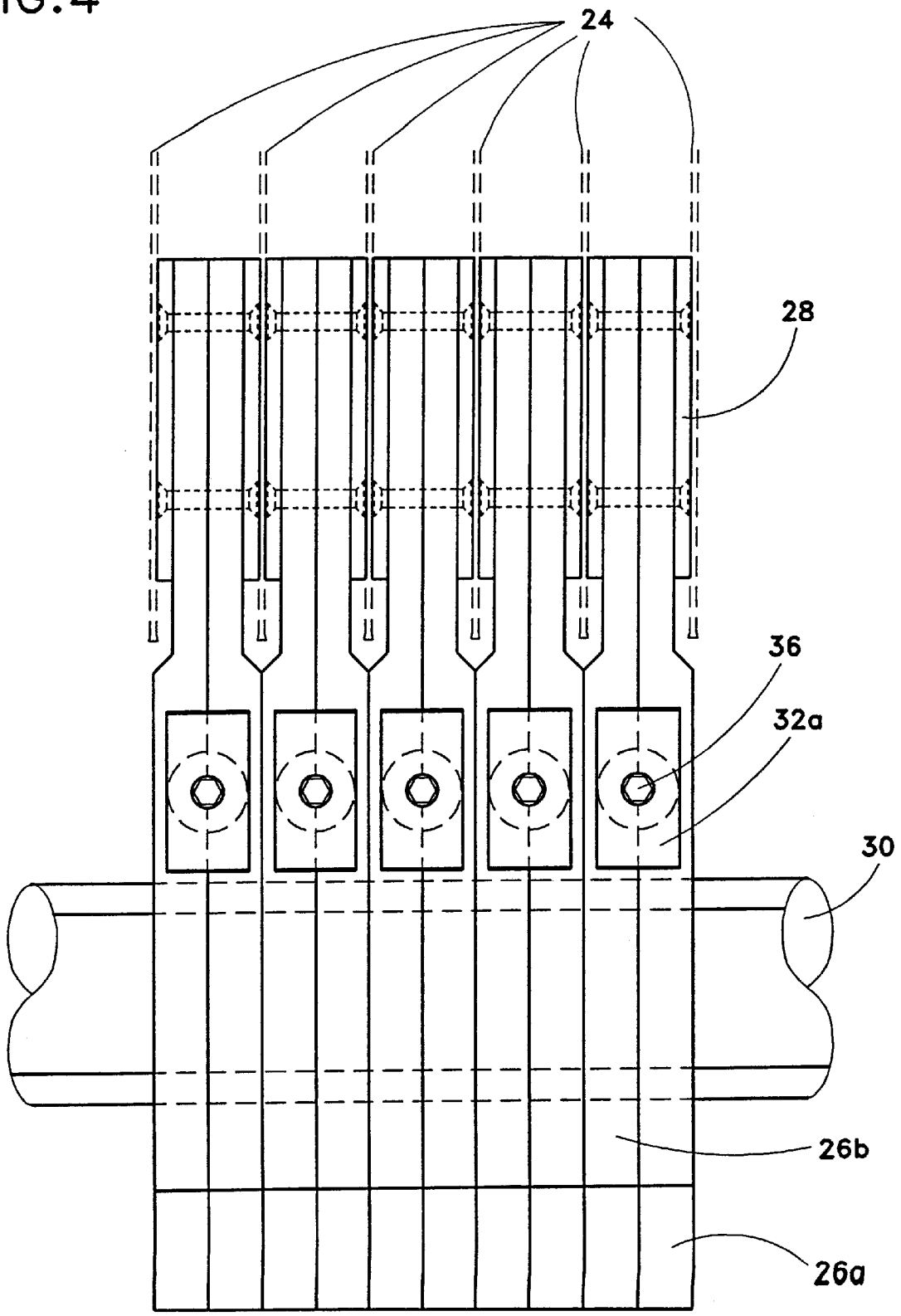
FIG. 4 is an enlarged, fragmentary, side cross-sectional view of the sawguides in their contracted position.

In operation the hydraulic press (not shown) is released and worm gear 40 is rotated a predetermined amount by a stepper motor or other means 42, as is desired for the particular target lumber size needed. The target lumber size which is desired dictates the size of the spacing between the saw blades. The worm gear 40 causes the linkage gear 38 to rotate, which in turn causes the flexible linkage 36 to rotate. Linkage 36 rotates threaded rod 34. Disc 34*a* holds the threaded rod 34 in a centered position for rotation between sawguide pairs 26. Thus wedges 32*a* and 32*b* are held apart an equal distance as wedges 32*a* and 32*b* are drawn towards disc 34*a* on rod 34 so as to ride up incline 26*c* within sawguide pairs 26 when threaded rod 34 is rotated one direction, thereby increasing the spacing between the sawguide pairs 26 as shown in FIG. 3. Wedges 32*a* and 32*b* are forced in opposite directions away from disc 34*a* toward the outer edges of sawguides 26, and thereby slide down incline 26*c* to thereby decrease the spacing between sawguide pairs 26 as shown in FIG. 4 when threaded rod 34 is rotated in the opposite direction. Thus selective rotation of rod 34 changes the spacing between saw blades 24.

During adjustment of saw blade spacing the hydraulic press 42 is actuated to hold a small residual pressure against the sawguides sets 26 and the wedges 32*a* and 32*b* to inhibit unwanted movement of wedges 32*a* and 32*b* and to inhibit debris from falling into the area of the wedges 32*a* and 32*b* as the lumber target size is adjusted. The hydraulic press 42 is actuated with substantial pressure once the sawguide spacing adjustment has been made and the desired width is selected, to thereby press sawguide sets 26 together, and clamp sawguides sets 26 to fix the target lumber size.

When zones of different thickness of target lumber sizes are required, the hydraulic press 42 is released, the sawguide sets 26 are slid apart, the flexible linkage 36 is detached, and the wedges 32*a* and 32*b* along with the threaded rod 34 can be changed to substitute wedges of different width. The required different width range of target lumber size in that particular zone of he gang is thus obtained.

Figure 6:
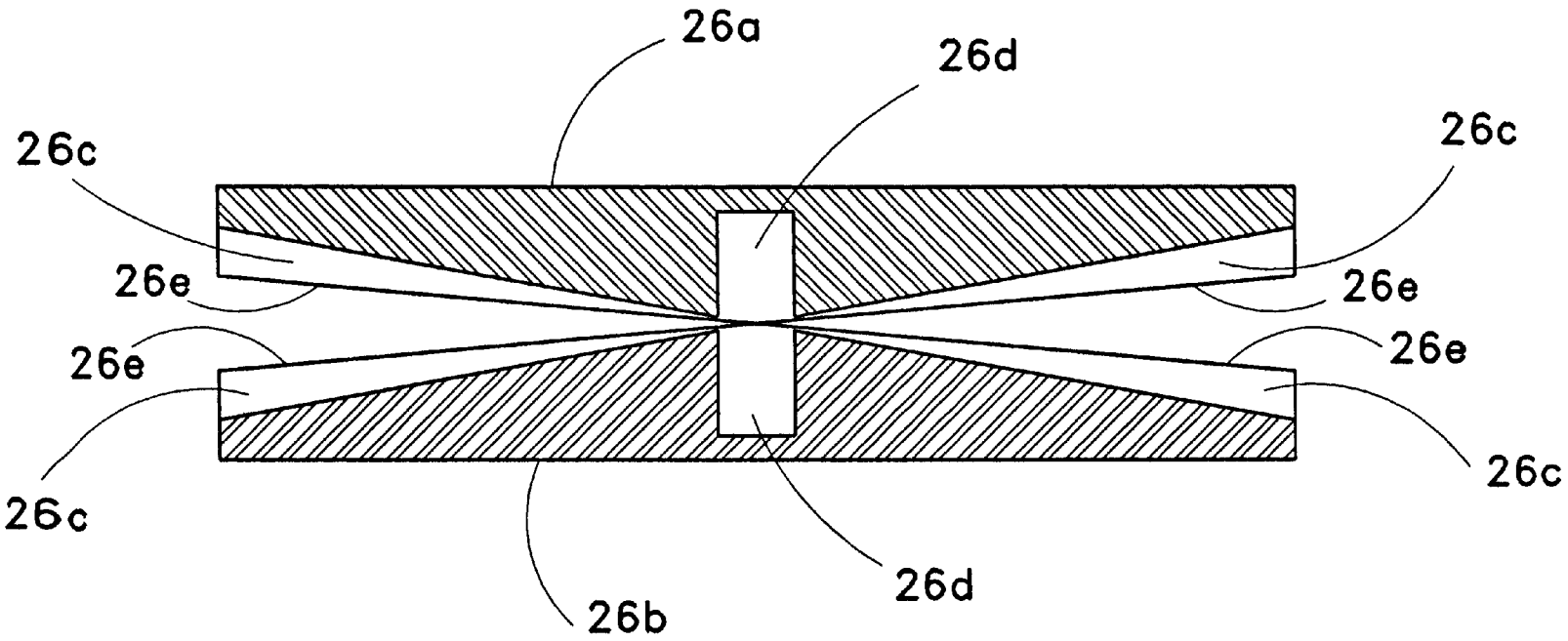
FIG. 6 is, in cross section, the sawguide plates in a modified embodiment.

As illustrated in FIG. 6, recessed inclines 26*c* on sawguide plates 26*a* and 26*b,* that accept wedges 32*a* and 32*b* in sliding engagement thereon, may form continuous inclines 26*e* therebetween extending the entire distance between recess 26*d* and the outermost edges of sawguide plates 26*a* and 26*b*. The continuous inclines 26*e* are provided so that sawdust buildup is forced outwards, as by squeezing, when wedges 32*a* and 32*b* are slid outwards to allow the spacing between the saw blades to be reduced.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A device for selectively actuable positioning of sawguides for circular gang saws mounted on a saw arbor shaft, comprising:

a first shaft extending along a first axis generally parallel to said saw arbor shaft, a plurality of first and second sawguides, said plurality of first and second sawguides slidably mounted on said first shaft for longitudinal sliding thereon, each of said first and second sawguides on laterally opposed sides of corresponding opposed pairs of first and second wedges, wherein said first and second wedges are mounted in threaded longitudinal engagement, in left and right threaded engagement respectively, on corresponding selectively rotatable second shafts between said plurality of first and second sawguides along second axes generally perpendicular to said first axis, said second shafts threadably journalled in said corresponding opposed pairs of first and second wedges and centered therein by a centering means for restraining longitidinal translation of said pairs of first and second wedges between said first and second sawguides during rotation of said second shafts, said opposed pairs of first and second wedges threadably mounted on said corresponding second shafts in opposed facing relation with vertices of said first and second wedges closest to a center position centered along said corresponding second shafts, means for selectively rotating said second shafts either individually or collectively, by rotating a selected or collective plurality of second shafts cooperatively journalled in a corresponding plurality of said first and second wedges, so as to, when selectively rotated in a first direction, force said first and second wedges towards said center position, and when selectively rotated in a second direction counter to said first direction so as to force said first and second wedges away from said center position, said selective rotating of a plurality of second shafts for forming saw blade zones with selected spacing between saw blades, a press for pressing said first and second sawguides slidably toward each other along said first shaft against said first and second wedges, respectively, whereby translation of said first and second wedges along said second shaft by reason of selective rotation of said second shaft causes relative longitudinal translation between said first and second sawguides on said first shaft.

2. The device of claim 1 wherein said first and second wedges have continuous inclines for sliding engagement with inclined surfaces on said first and second sawguides.

3. The device of claim 1 wherein the said vertices of said first and second wedges are equidistant from said center position.

4. A method for selectively actuable positioning of sawguides in circular gang saws mounted on a saw arbor shaft, wherein a first shaft extends along a first axis generally parallel to said saw arbor shaft, wherein a plurality of first and second sawguides are slidably mounted on said first shaft, each of said first and second sawguides enclose opposed pairs of first and second wedges between laterally opposite sides of said first and second sawguides, and wherein said first and second wedges are mounted in threaded longitudinal engagement, in left and right threaded engagement respectively, on corresponding selectively rotatable second shafts between said plurality of first and second sawguides along second axes generally perpendicular to said first axis, said second shafts threadably journalled in said corresponding opposed pairs of first and second wedges and centered therein by a centering means for restraining longitudinal translation of said pairs of first and second wedges between said first and second sawguides during rotation of said second shafts, said opposed pairs of first and second wedges threadably mounted on said corresponding second shafts in opposed facing relation with vertices of said first and second wedges closest to a center position centered along said corresponding second shafts, means for selectively rotating said second shafts either individually or collectively, by rotating a selected or collective plurality of second shafts cooperatively journalled in a corresponding plurality of said first and second wedges, so as to, when selectively rotated in a first direction, force said first and second wedges towards said center position, and when selectively rotated in a second direction counter to said first direction so as to force said first and second wedges away from said center position, said selective rotating of a plurality of second shafts for forming saw blade zones with selected spacing between saw blades, a press for pressing said first and second sawguides slidably toward each other along said first shaft against said first and second wedges, respectively, whereby translation of said first and second wedges along said second shaft by reason of selective rotation of said second shaft causes relative longitudinal translation between said first and second sawguides on said first shaft, said method comprising the steps of:

(a) selectively rotating, by means for selectively rotating, said second shafts either individually or collectively, by rotating a selected or collective plurality of second shafts cooperatively journalled in a corresponding plurality of said first and second wedges, so as to, when selectively rotated in a first direction, force said first and second wedges toward said center position, and when selectively rotated in a second direction counter to said first direction so as to force said first and second wedges away from said center position, said selective rotating of a plurality of second shafts forming saw blade zones with selected spacing between saw blades, (b) pressing, by said press, said first and second sawguides slidably towards each other along said first shaft against said first and second wedges, respectively, whereby translation of said first and second wedges along said second shaft by reason of selective rotation of said second shaft causes relative longitudinal translation between said first and second sawguides on said first shaft.

5. The method of claim 4 further comprising the step of sliding said first and second wedges, on continuous inclines on said first and second wedges, over inclined surfaces on said first and second sawguides.

* * * * *

UNITED STATES PATENT AND TRADEMARK OFFICE

CERTIFICATE OF CORRECTION

PATENT NO. : 5,927,174

DATED : July 27, 1999

INVENTOR(S) : William R. Newnes; Steven Michell; John Sergeant

It is certified that error appears in the above-identified patent and that said Letters Patent is hereby corrected as shown below:

Column 3, Line 49
delete"A-A"
insert --5b-5b--

Signed and Sealed this

Twenty-third Day of May, 2000

*Attest:*

Q. TODD DICKINSON

*Attesting Officer*

*Director of Patents and Trademarks*